United States Patent [19]

Montoriol

[11] 4,440,199

[45] Apr. 3, 1984

[54] METHOD OF FORMING WIRING FOR BOTTLE STOPPERS

[75] Inventor: Bernard Montoriol, Germaine, France

[73] Assignee: Etablissements F. Valentin, Epernay, France

[21] Appl. No.: 285,660

[22] Filed: Jul. 21, 1981

[30] Foreign Application Priority Data

Jul. 23, 1980 [FR] France ..... 80 16404

[51] Int. Cl.[3] ..... B21F 45/00

[52] U.S. Cl. ..... 140/71 R; 140/94; 140/111

[58] Field of Search ..... 215/278,219; 140/85, 140/94, 71 R, 111, 115

[56] References Cited

U.S. PATENT DOCUMENTS

| | | | |
|---|---|---|---|
| 445,803 | 2/1891 | Curtis | 140/94 |
| 2,674,913 | 4/1954 | Thomas | 140/71 R |
| 3,379,328 | 4/1968 | Plion | 215/291 |

FOREIGN PATENT DOCUMENTS

| | | | |
|---|---|---|---|
| 461581 | 10/1913 | France | 215/291 |

*Primary Examiner*—Francis S. Husar
*Assistant Examiner*—Linda McLaughlin
*Attorney, Agent, or Firm*—Dowell & Dowell

[57] ABSTRACT

A method for the manufacture of stopper wirings which consists:

in shaping wires to a profile including in a first plane a central portion in the form of an arc of circle and two straight branches, in disposing the shaped wires to form a complete ring, the straight branches extending outwardly from the ring, in twisting each branch along a first portion of its length starting from the ring, in twisting locally the remaining portion of each branch in a zone intermediate between the twisted portion and the outer end, and in rolling the end of the remaining portion of each branch in the shape of a loop to form one leg of the wiring.

1 Claim, 6 Drawing Figures

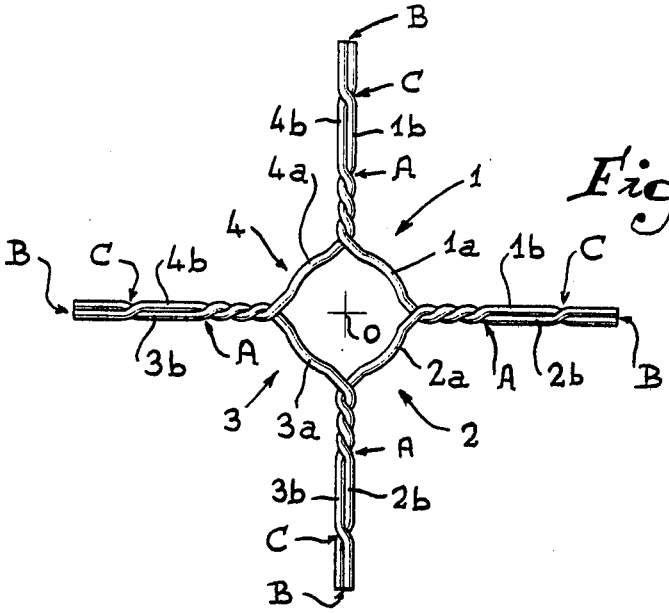
Fig. 3
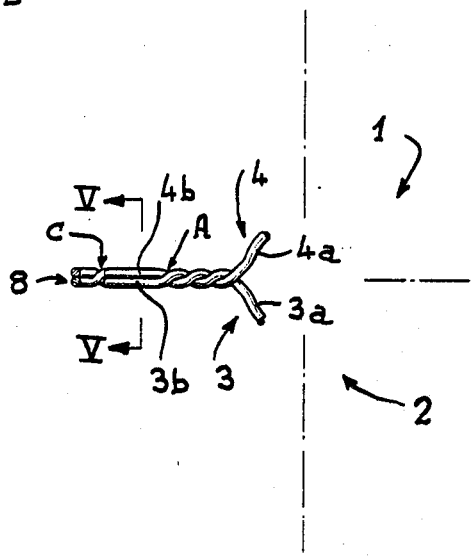
Fig. 4
Fig. 5
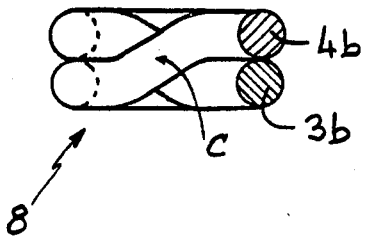
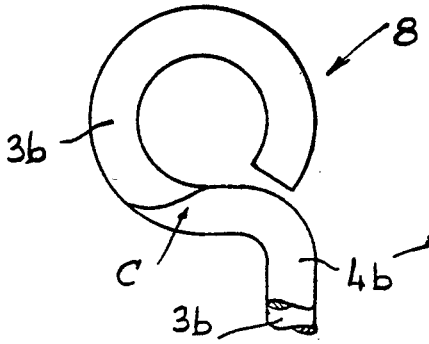
Fig. 6

METHOD OF FORMING WIRING FOR BOTTLE STOPPERS

This invention refers to wirings which are disposed on bottles containing champagne or like sparkling wines to retain the stopper against the inner pressure which tends to expel it.

These wirings are generally made of tinned or galvanized wire. They comprise a central or upper ring adapted to bear on the head of the stopper and four legs which extend downwardly from this ring around the stopper and the neck of the bottle below the peripheral rib or ring of this neck where they receive a wire or belt which connects these legs with each other while clamping them against the neck. In the conventional manufacturing process these wirings are realized by means of a single wire which is appropriately folded and twisted. Two wires have sometimes been used in order to facilitate the operations, to reduce the time required and therefore to lower the manufacturing cost.

A problem which has however been encountered in the prior art is that in order to connect the belt wire with the legs, the ends of these latter should be in the form of small loops through which the said belt wire may be threaded. Now when such wirings are piled in the magazine of an automatic distributing machine these loops which are not quite uniformly orientated, become sometimes hooked with each other, thus causing stoppage of the machine and necessitating intervention of an operator.

It is an object of the present invention to reduce the time required for the manufacture of such wirings while at the same time avoiding the above-mentioned drawback.

In accordance with this invention a stopper wiring is achieved by means of four wires each one of which is so shaped as to comprise a central portion in the form of an arc of a circle extending through about 90° and two elementary branches which extend from the ends of this arc, substantially radially with respect to the center thereof. These wires are disposed to form a central ring with four double branches extending therefrom, and the said double branches are then twisted in order to unite their elementary branches with each other in the form of a single leg only a portion of their length starting from the central ring, these elementary branches beyond said twisted portions being parallel and in contact with each other over most of the remaining portion of this length. Near the ends of the elementary branches of the central zone of this remaining portion, they are twisted through half a full turn, and then finally rolled at the ends of said remaining portion to form a terminal loop in such a manner that the twisted double branch becomes the equivalent of one leg of a conventional stopper wiring. All what is thereafter needed is to conform the wiring to the shape of the stopper by folding the legs downwardly.

In the annexed drawing:

FIG. 3 shows the partly formed wiring after the elementary branches have been twisted along part of their length starting from the central ring.

FIG. 4 is a fragmental view showing a double branch after its end has been rolled to form a terminal loop (the said loop being shown in section).

FIG. 5 is an enlarged cross-section taken along line V—V of FIG. 4.

FIG. 6 is a side view corresponding to FIG. 5.

Figure 1:
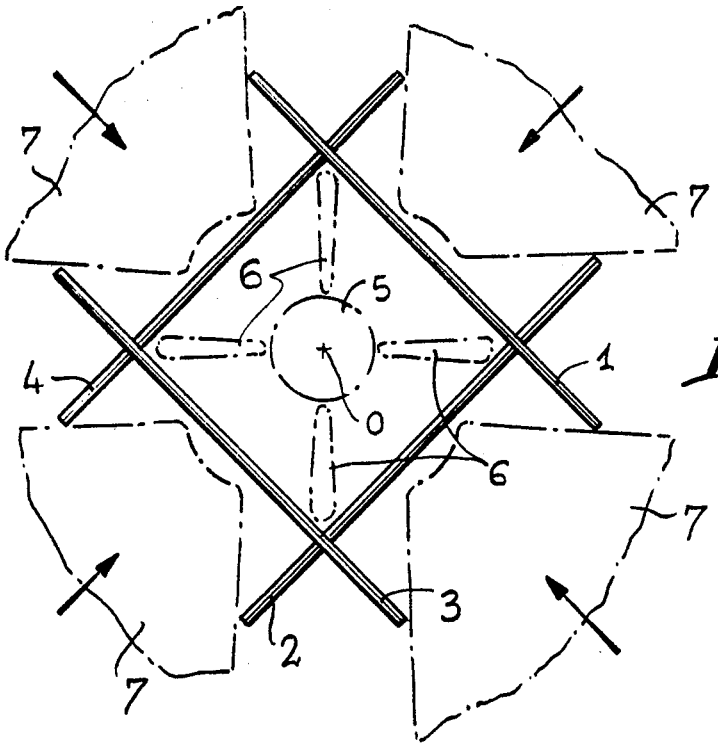
FIG. 1 shows four wire components disposed at right angles to each other on an appropriate support for the manufacture of a stopper wiring according to the invention.

In FIG. 1 four wires 1, 2, 3 and 4 are disposed on an appropriate flat support (not illustrated) at right angles to each other to form a square with each wire extending at both ends beyond this square, as shown. These wires are cut from tinned or galvanized iron wire, but any other kind of wire may be used, if desired. The support on which they rest may include appropriate centering means. The wires may be deposited thereon automatically. Wires 2 and 4 may be placed first on the support, and wires 1 and 3 being thereafter laid on them, as illustrated in FIG. 1.

The second step consists in shaping the four wire components in such manner that each comprises in its central zone an arc of a circle 1*a*, 2*a*, 3*a*, 4*a*, (FIG. 2) extending through about 90° around a common center 0, with straight elementary branches 1*b*, 2*b*, 3*b*, 4*b* extending from the ends of this arc, radially with respect to point 0. As indicated in dash and dot lines in FIG. 1, this shaping of the wire components may be effected by means of a stationary central core 5, of four stationary blade-like abutments 6 radially disposed around the said core, and of four appropriately profiled plungers 7 displaceable in the direction of point 0 to apply the central portion of each wire against the core 5, the elementary branches being retained by abutments 6. It will be noted that abutments 6 and plungers 7 may be used as centering means for properly disposing sections 1, 2, 3, 4 on the support. It will also be remarked that owing to the presence of abutments 6, in each pair of elementary branches, such as for instance 4*b*–1*b*, these latter diverge slightly with respect to one another. Each of these pairs may be conveniently referred to as a double branch.

The third step consists in twisting each double branch along a portion of its length starting from the central ring formed by arcs 1*a*, 2*a*, 3*a*, 4*a*. In FIG. 3 the point at which the twisting stops has been referenced A. The twisting operation proper may be easily effected by means of rotating grippers which are advanced radially up to point A for each double branch and which close on this latter with a relatively limited force, in order that the wires may slide towards each other during the twisting operation. When the grippers have been rotated through a given number of turns (three in the example illustrated) they are automatically opened and radially removed. Each double branch now comprises a first or twisted portion followed by a remaining portion AB in which the wires are parallel and in mutual contact. In actual practice the twisted portion may represent about one third of the total length of the double branch. Of course during the twisting operation curved portions 1*a*, 2*a*, 3*a*, 4*a* are prevented from being twisted, as for instance by remaining applied around core 5 of FIG. 1.

During the fourth step the two wires or elementary branches which constitute each remaining portion AB are inverted with respect to each other. This is easily obtained by locally twisting these wires through one half of a turn at a point referenced C in FIG. 3. Here again this additional twisting operation may be performed by rotating grippers advanced radially up to point C, the zone comprised between points A and C being clamped in any appropriate manner, as for instance between two vertically moving jaws.

In another practical embodiment the third and fourth steps are effected simultaneously by means of two independent sets of grippers, the first one being applied against portion AC and the second one against portion CB, and the second pair rotating one half turn more than the first one.

During the fifth step the ends of the double branches are rolled substantially between point A and B of FIG. 3 in such manner as to form a loop in a plane perpendicular to the plane of said FIG. 3. Each double branch then becomes a leg of the final wiring. Such a rolling operation is well known in the art and need not therefore be described. It is however to be noted, this being very important, that the inversion point C is situated in the rolled portion or loop as clearly illustrated in FIGS. 4 to 6 wherein the said loop has been referenced 8. It results therefrom that the two portions such as 3*b* and 4*b* which constitute this loop 8 are strongly maintained against each other and are not liable therefore to become orientated at random and to engage or become hooked to a portion of another wiring in the magazine of an automatic machine.

As above indicated FIG. 4 is only a fragmental view illustrating a single double branch or leg. The positions of the three other legs are indicated in dash and dot lines.

In order to obtain the finally desired stopper wiring, it is now sufficient to bend downwardly the four legs which have thus been formed. This operation may be performed either separately on the successive formed wirings, or only when each is being mounted on a bottle.

Figure 2:
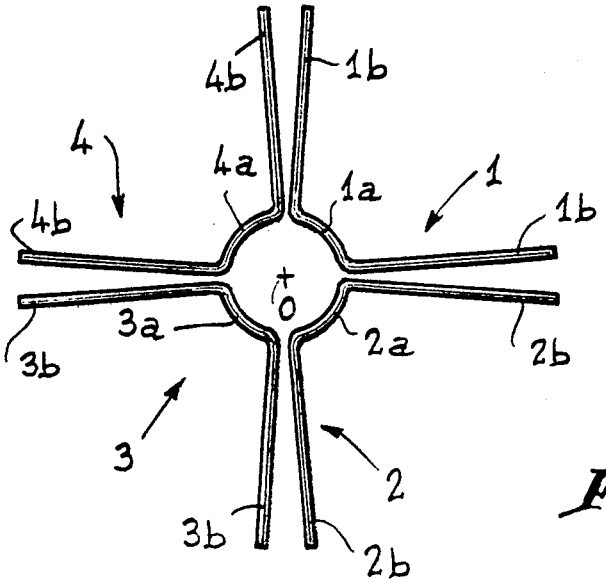
FIG. 2 illustrates these wire components after the first operating step, i.e. the formation of a central ring with four pairs of elementary branches extending therefrom.

It is obvious that the wires referenced 1, 2, 3 and 4 in FIG. 1 could be shaped separately to the profile shown for each in FIG. 2 and thereafter assembled on the support around a central core. In such a case the elementary branches of each such as 1*b* could be exactly at 90° to each other, which would avoid the slight divergence illustrated in FIG. 2 and would facilitate the twisting operation. Also, although in practice each stopper wiring should have four legs, it is conceivable to manufacture such devices having for instance six legs, the central portion of each section extending through 60° instead of 90°.

I claim:

1. The method of manufacturing wiring for securing a stopper in a bottle of sparkling liquid, comprising the steps of:

(a) shaping multiple wires to provide multiple separate components, each having a central arcuate portion with two straight branches comprising the ends of the wire lying in the same plane as the arcuate portion and extending outwardly substantially radially therefrom;

(b) supporting said components substantially in a common plane with their arcuate portions forming a circle about a central point in the plane and their straight branches extending in pairs away from said point to provide multiple double branches;

(c) twisting the straight branches of each double branch along a first portion of their lengths which extends from their arcuate portions part-way toward their outer ends, and stopping the twisting to leave an intermediate straight portion of the double branches wherein the branches extend mutually parallel;

(d) further twisting the branches of each double branch to form a second twisted portion located beyond said intermediate straight portion and near said outer ends; and (e) rolling each double branch near its outer ends to form a loop terminating the double branch, each loop lying substantially normal to said common plane and each loop including the second twisted portion of the associated double branch.

* * * * *